US006182970B1

(12) United States Patent
Fushihara et al.

(10) Patent No.: US 6,182,970 B1
(45) **Date of Patent: *Feb. 6, 2001**

(54) HOLLOW GOLF BALL

(75) Inventors: Kazuhisa Fushihara, Kakogawa; Kiyoto Maruoka, Kobe; Kazuo Hochi, Amagasaki; Akihiro Nakahara, Ibaraki, all of (JP)

(73) Assignee: Sumitomo Rubber Industries, Ltd., Hyogo-ken (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/178,618

(22) Filed: Oct. 26, 1998

(30) Foreign Application Priority Data

Oct. 28, 1997 (JP) ..... 9-295285

(51) Int. Cl.[7] ..... A63B 37/02
(52) U.S. Cl. ..... 273/375; 273/351
(58) Field of Search ..... 473/354, 375, 473/355, 351, 358

(56) References Cited

U.S. PATENT DOCUMENTS 5,150,906 * 9/1992 Molitor et al. ..... 473/354
5,480,155 * 1/1996 Molitor et al. ..... 473/354

* cited by examiner

*Primary Examiner*—Jeanette Chapman
*Assistant Examiner*—V K Mendiratta
(74) *Attorney, Agent, or Firm*—Birch, Stewart, Kolasch & Birch, LLP

(57) ABSTRACT

A hollow golf ball having good shot feel at the time of hitting, while maintaining excellent flight performance, wherein the hollow golf ball has a hollow core having a hollow portion and one or more hollow core outer layers formed thereon, the hollow core outer layers having a core composition containing rubber, a resin or a mixture thereof, and a cover formed on the hollow core, and wherein the hollow portion has a diameter of 5 to 25 mm, the hollow core outer layer has a surface hardness of 71 to 91 in JIS-C hardness and a deformation amount of 2.0 to 3.5 mm when applying from an initial load of 10 kgf to a final load of 130 kgf on the core.

7 Claims, 2 Drawing Sheets

HOLLOW GOLF BALL

FIELD OF THE INVENTION

The present invention relates to a hollow golf ball. More particularly, the present invention relates to a hollow golf ball having good shot feel at the time of hitting, while maintaining excellent flight performance.

BACKGROUND OF THE INVENTION

Hitherto, there have been mainly produced two types of golf balls. The one is a solid golf ball, such as a two-piece golf ball or three-piece golf ball, and the other is a thread wound golf ball. The solid golf ball, when compared with the thread wound golf ball, has better durability and better flight performance because of a larger initial velocity at the time of hitting and longer flight distance. Therefore, the solid golf ball is generally approved or utilized by many golfers, particularly amateur golfers. With regard to enhancement of flight distance, the development of the golf ball has mainly focused on solid golf balls rather than thread wound golf balls.

On the other hand, the solid golf ball exhibits hard and poor shot feel at the time of hitting. It has been known that the flight distance is largely affected by the rebound characteristics of the solid golf ball. Recently, in order to improve the shot feel of the solid golf ball, it has been attempted to soften the core of the solid golf ball to reduce the hardness of the golf ball. However, there is the drawback that the rebound characteristics of the golf ball are degraded and the flight performance is reduced, because of the softening of the core.

These performances are generally governed by two factors, that is the surface hardness of the core and the deformation amount of the core. When the surface hardness is larger, the deformation amount is reduced and the rebound characteristics are enhanced, but the shot feel is poor. On the other hand, when the surface hardness is smaller, the deformation amount is decreased and the shot feel is enhanced, but the rebound characteristics are degraded. Therefore, it is very difficult to improve both flight distance and shot feel of the conventional, solid golf ball having a solid core.

SUMMARY OF THE INVENTION

A main object of the present invention is to provide a hollow golf ball having good shot feel at the time of hitting, while maintaining excellent flight performance.

According to the present invention, the object described above has been accomplished by providing a golf ball with a hollow core composed of a hollow portion and a hollow core outer layer and by adjusting the diameter of the hollow portion of the golf ball, the surface hardness of the hollow core in JIS-C hardness and the deformation amount when applying from an initial load of 10 kgf to a final load of 130 kgf on the core to a specific range. Thus a hollow golf ball is provided having good shot feel at the time of hitting, while maintaining excellent flight performance.

The above object as well as other objects and advantages of the present invention will become apparent to those skilled in the art from the following description with reference to the accompanying drawings, wherein

SUMMARY OF THE INVENTION

The present invention provides a hollow golf ball comprising a hollow core composed of a hollow portion and one or more hollow core outer layers formed from a core composition comprising a rubber, a resin or a mixture thereof, and a cover formed on the hollow core, wherein the hollow portion has a diameter of 5 to 25 mm, the hollow core has a surface hardness of 77 to 91 in JIS-C hardness and a deformation amount of 2.0 to 3.5 mm when applying from an initial load of 10 kgf to a final load of 130 kgf on the core.

The hollow golf ball is excellent in shot feel and flight distance, because the hollow core increases the deformation of the golf ball to improve shot feel and increases moment of inertia to extend flight distance. According to the present invention, the deformation is made adjustable when keeping the surface hardness of the core to a constant value. That is, even when the surface hardness of the core is high and therefore the deformation can be made large, it is possible to improve both flight distance and shot feel of the golf ball.

DETAILED DESCRIPTION OF THE INVENTION

Figure 1:
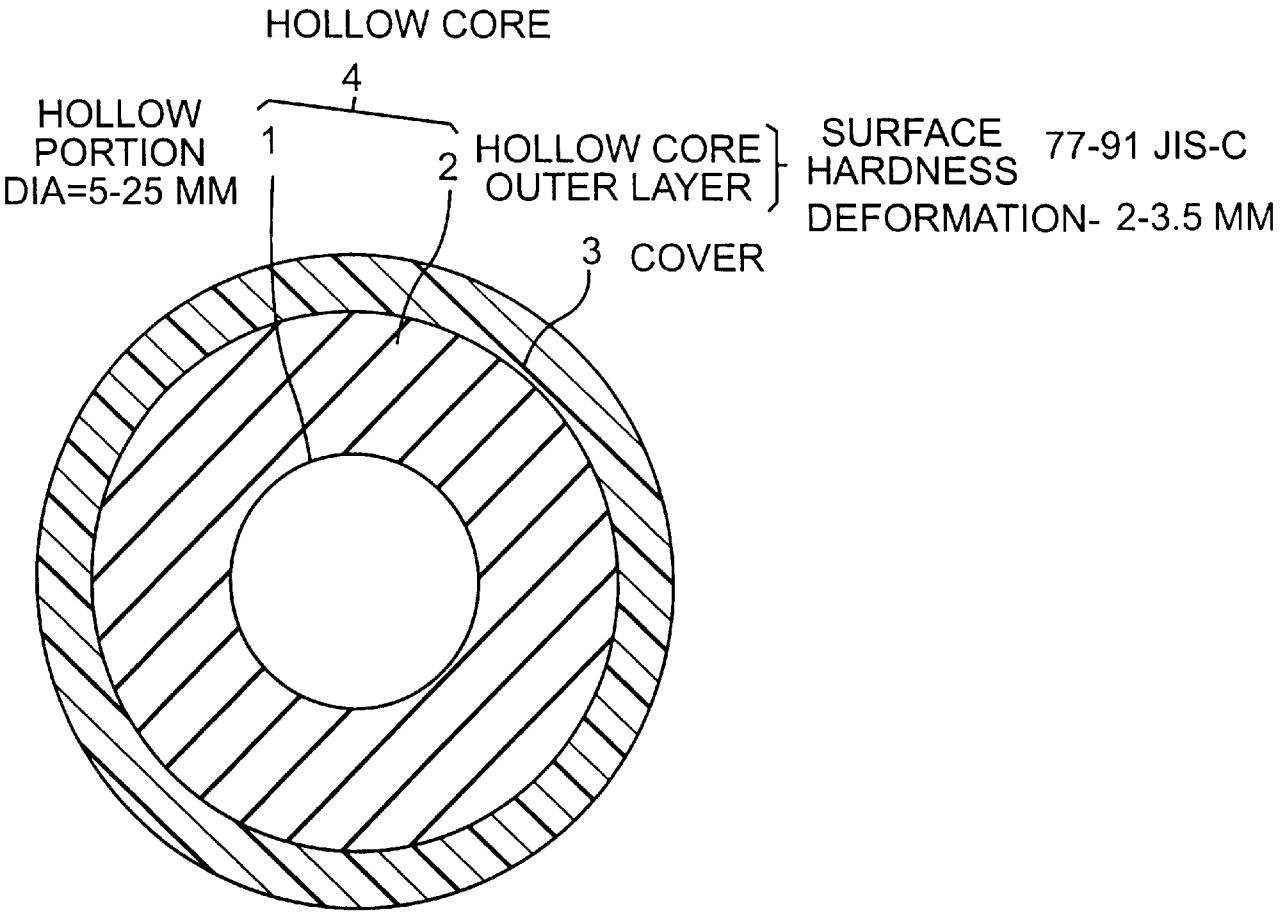
FIG. 1 is a schematic cross section illustrating one embodiment of the hollow golf ball of the present invention.

The present invention will be described in detail hereinafter. FIG. 1 is a schematic cross section illustrating one embodiment of the hollow golf ball of the present invention. The golf ball of the present invention comprises a hollow core 4 which is composed of a hollow portion 1 and one or more hollow core outer layers 2, and a cover 3 formed on the core. When the diameter of the hollow portion 1 is larger, the deformation amount increases to improve the shot feel, but the rebound characteristics are degraded. On the other hand, when the diameter of the hollow portion is smaller, the deformation amount is reduced to degrade the shot feel, but the rebound characteristics are improved. Therefore, the diameter of the hollow portion is within the range of 5 to 25 mm, preferably 8 to 22 mm, more preferably 10 to 20 mm, in order to optimize the rebound characteristics and the shot feel.

The hollow core outer layer 2 is formed from a core composition mainly containing rubber component, resin component or the mixture thereof, and may have single layer structure or multi-layer structure which has two or more layers. When the hollow core outer layer 2 has multi-layer structure, the hollow outer layers may be formed from the same material or different material. It is preferable that the hollow core outer layer 2 is formed from a core composition mainly containing a rubber component in order to improve both rebound characteristics and shot feel.

When the hollow core outer layer 2 of the present invention is formed from a core composition mainly containing a rubber component, it is obtained by vulcanizing or press-molding the rubber composition which can be typically used for the core of golf ball. The rubber composition typically comprises a base rubber, a metal salt of unsaturated carboxylic acid, an organic peroxide, a filler and the like.

The base rubber may be natural rubber and/or synthetic rubber which has been conventionally used for solid golf balls. Preferred is a high cis-polybutadiene rubber containing a cis-1, 4 bond of not less than 40%, preferably not less than 90%. The polybutadiene rubber may be mixed with natural rubber, polyisoprene rubber, styrene-butadiene rubber, ethylene-propylene-diene rubber (EPDM), and the like. The base rubber is preferably present in an amount of not less than 80% by weight, based on the total rubber composition, in order to impart high rebound characteristics to the resulting golf ball.

The metal salt of an unsaturated carboxylic acid, which acts as a co-crosslinking agent, includes monovalent or divalent metal salts, such as zinc or magnesium salts of α, β-unsaturated carboxylic acids having 3 to 8 carbon atoms (e.g. acrylic acid, methacrylic acid, etc.). A preferred co-crosslinking agent is zinc acrylate because it imparts high rebound characteristics to the resulting golf ball. The amount of the metal salt of the unsaturated carboxylic acid in the rubber composition is preferably 20 to 40 parts by weight, based on 100 parts by weight of the base rubber. When the amount of the metal salt of the unsaturated carboxylic acid is larger than 40 parts by weight, the core is too hard, thus shot feel is poor. On the other hand, when the amount of the metal salt of the unsaturated carboxylic acid is smaller than 20 parts by weight, the core is too soft. Therefore, rebound characteristics are degraded to reduce flight distance.

The organic peroxide, which acts as a crosslinking agent or a hardener, includes, for example, dicumyl peroxide, t-butyl peroxide and the like. Preferred organic peroxide is dicumyl peroxide. The amount of the organic peroxide is preferably from 0.5 to 5.0 parts by weight, based on 100 parts by weight of the base rubber. When the amount of the organic peroxide is smaller than 0.5 parts by weight, the core is too soft. Therefore, rebound characteristics are degraded to reduce flight distance. On the other hand, when the amount of the organic peroxide is larger than 5.0 parts by weight, the core is too hard, thus shot feel is poor.

The filler, which can be typically used for the core of golf ball, includes for example, an inorganic filler (such as zinc oxide, barium sulfate, calcium carbonate and the like), a metal powder having high a specific gravity (such as tungsten powder, molybdenum powder, and the like), and mixtures thereof. Since the hollow core employed in the present invention has a lighter weight than a conventional solid core because of the presence of the hollow portion, a combination of the inorganic filler and the high specific gravity metal powder is preferable. The amount of the filler is preferably from 10 to 120 parts by weight, based on 100 parts by weight of the base rubber. When the amount of the filler is smaller than 10 parts by weight, the technical effects accomplished by using the filler for the hollow core are not obtained. On the other hand, when the amount of the filler is larger than 120 parts by weight, the weight ratio of the rubber component in the core is too low. Therefore, the rebound characteristics of the resulting golf ball are degraded.

The rubber composition for the hollow core outer layer 2 used in the present invention can optionally contain other components which have been conventionally used for preparing the core of solid golf balls, such as an antioxidant or a peptizing agent.

When the hollow core outer layer 2 used in the present invention has a multi-layer structure which has two or more layers, the hollow core outer layer preferably has at least one layer formed from the rubber composition. It is preferable to position the layer formed from the rubber composition as the external layer of the hollow core in order to improve both rebound characteristics and shot feel. The hollow core outer layer 2 has a thickness of not less than 5 mm, preferably not less than 7 mm in order to improve both rebound characteristics and shot feel.

The hollow core outer layer 2 of the present invention may be obtained by a method which comprises the steps of forming the rubber composition for the hollow core into a semi-vulcanized semi-spherical half-shell having a concave portion, bonding the two semi-vulcanized half-shells and completely vulcanizing, a method which comprises the steps of bonding the two vulcanized semi-spherical half-shells with adhesive, or a method of injection molding the rubber composition, and the like. The term "semi-vulcanized" as used herein refers to a state that a rubber composition is vulcanized but vulcanization stops before completely finishing the crosslinking reaction. The semi-vulcanized article can keep its molded shape, and can be further vulcanized to complete the crosslinking reaction when heating. The semi-vulcanization may be preferably adjusted to a condition that vulcanizing time is from quarter to half of the time of complete vulcanization, preferably about one third of the condition of complete vulcanization. When complete vulcanization is conducted, for example, at 150° C. for 30 minutes, a state of semi-vulcanization can be obtained by vulcanizing at 150° C. for about 15 minutes. In case of the hollow core 4 of the present invention, since complete vulcanization is typically conducted at 150 to 170° C. for 10 to 30 minutes, a state of semi-vulcanization may be obtained by stopping vulcanization at the same temperature for about half of the vulcanizing time.

When the hollow core outer layer 2 is formed from a core composition mainly containing a resin component, the hollow core outer layer may be obtained by forming a half-shell by a typical molding method (such as injection-mold and the like), and then bonding the two half-shells with adhesive. Examples of the resin components include which is not limited to a typical thermoplastic resin that can be injection-molded, include thermoplastic elastomer which is composed of hard segment and soft segment, and the mixture thereof. The thermoplastic resin has a melting point of not less than 150° C., preferably not less than 160° C., more preferably not less than 170° C. The use of the resin component having a higher melting point can prevent the hollow core from easily deforming when vulcanizing or press-molding a core rubber layer on a hollow center. Examples of the thermoplastic resins include, for example, polyethylene, polypropylene, polystyrene, polyvinyl chloride, polymethyl methacrylate, polyacetal, polyamide, polyoxymethylene, polycarbonate, polyester, polyphenylene oxide, polysulfone, polyimide, etc. or combinations thereof. Examples of the thermoplastic elastomers include polyester-type thermoplastic elastomer, urethane-type thermoplastic elastomer, styrene-type thermoplastic elastomer, polyamide-type thermoplastic elastomer, etc. or combinations thereof. Preferred is an polyester-type thermoplastic elastomer or an urethane-type thermoplastic elastomer, because it can impart high rebound characteristics to the resulting golf ball. The core composition may contain fillers for adjusting specific gravity, rubber microparticles for imparting flexibility to the resulting golf ball, crosslinking agent for the rubber microparticles, etc., in addition to the resin component.

It is required that the hollow core 4 used for the golf ball of the present invention has a deformation amount of 2.0 to 3.5 mm, preferably 2.0 to 3.0 mm, when applying from an initial load of 10 kgf to a final load of 130 kgf on the core. The deformation amount can be adjusted by selecting other vulcanization conditions, as well as an amount of metal salt of unsaturated carboxylic acid or an amount of organic peroxide. When the deformation amount is larger than 3.5 mm, the core is too soft. Therefore, rebound characteristics of the resulting golf ball are degraded to reduce flight distance. Also the durability of the golf ball is degraded (the cover of the golf ball is easily cracked) because of increasing the deformation amount of the golf ball at the time of hitting. On the other hand, when the deformation amount is smaller than 2.0 mm, the core is too hard. Therefore, the impact force of the resulting golf ball increases, and shot feel is poor.

It is required that the hollow core 4 used for the golf ball of the present invention has a surface hardness in JIS-C hardness of 77 to 91, preferably 80 to 88. When the surface hardness is smaller than 77, the core is too soft. Therefore, rebound characteristics of the resulting golf ball are degraded to reduce flight distance. On the other hand, when the surface hardness is larger than 91, the core is too hard. Therefore, impact force of the resulting golf ball increases and thus the shot the feel is poor. When the surface hardness is within the range of 77 to 91, the shot feel is not degraded, even if the surface hardness is high.

The diameter of the hollow core 4 used for the golf ball of the present invention is not limited and can vary depending on the thickness of the cover or whether the core outer layer has single layer structure or multi-layer structure, but typically is 35 to 40 mm.

When the internal pressure of the hollow core 4 is higher than atmospheric pressure, or lower than atmospheric pressure, production of the golf ball becomes difficult, or the cost of production becomes high, and therefore it is not very desirable. Particularly when the internal pressure of the hollow core 4 is lower than atmospheric pressure, there is the problem that the hollow core easily deforms at the step of covering it with the cover and the like. On the other hand, when the internal pressure of the hollow core 4 is much higher than atmospheric pressure, the technical effects of improving shot feel by the presence of the hollow portion are reduced. For the above reason, it is preferable that the internal pressure of the hollow core 4 in the resulting golf ball is approximately atmospheric pressure to 1 kgf/cm$^2$, preferably approximately atmospheric pressure to 0.5 kgf/cm$^2$, more preferably approximately atmospheric pressure. A method of encapsulating gas in the core at atmospheric pressure shows the most excellent production efficiency, and therefore is preferable. The internal pressure of the hollow portion of the resulting golf ball of the Examples and Comparative Examples is approximately atmospheric pressure, because the hollow golf ball is produced by encapsulating air in the hollow portion at atmospheric pressure. In this context, the wording "approximately atmospheric pressure" corresponds to the change of internal pressure occurring by the difference between the temperature of the encapsulating gas and the temperature of the resulting golf ball (ordinary temperature). Concretely, the temperature of the encapsulating gas can be controlled by controlling the temperature of the gas, ambient temperature of the molding room or the temperature of the molding components. The production efficiency and cost of production are improved by adjusting the temperature to not more than 100° C., preferably not more than 50° C., considering the controllable temperature range. When a temperature change is 100° C., an internal pressure change is 40%. When a temperature change is 50° C., an internal pressure change is 20%. It is required to encapsulate air at much higher temperature or much lower temperature in order to impart larger temperature difference, thereby the production efficiency is degraded and the cost of production is high. For the above reason, the internal pressure of the resulting golf ball at ordinary temperature is within the range of atmospheric pressure ±40%, preferably atmospheric pressure ±20%.

The cover 3 is then covered on the hollow core 4 obtained as described above. The cover may be formed from thermoplastic resins, which has been conventionally used for forming the cover of solid golf balls, such as ionomer resin, balata and the like. Preferred is ionomer resin. The cover used in the present invention may optionally contain the other resin in addition to the ionomer resin, such as polyamide resin, polyester resin and the like. The cover used in the present invention may optionally contain fillers (such as barium sulfate, etc.), pigments (such as titanium dioxide, etc.), and the other additives such as a UV absorber, a photostabilizer and a fluorescent agent or a fluorescent brightener, etc., in addition to the resin component, as long as the addition of the additives does not deteriorate the desired performance of the golf ball cover, but an amount of the pigment is preferably from 0.1 to 0.5 parts by weight based on 100 parts by weight of the cover resin component.

The cover used in the present invention is formed by a conventional method for forming golf ball cover well known in the art, such as injection molding, press-molding and the like. The cover has a thickness of 1.0 to 5.0 mm, preferably 2.0 to 3.5 mm. At the time of cover molding, many depressions called "dimples" may be typically formed on the surface of the golf ball. Furthermore, paint finishing or marking stamp may be optionally provided after cover molding for serving commercial sell.

EXAMPLES

The following Examples and Comparative Examples further illustrate the present invention in detail but are not to be construed to limit the scope thereof.

Examples 1 to 7 and Comparative Examples 1 to 5

Production of hollow core

Figure 2:
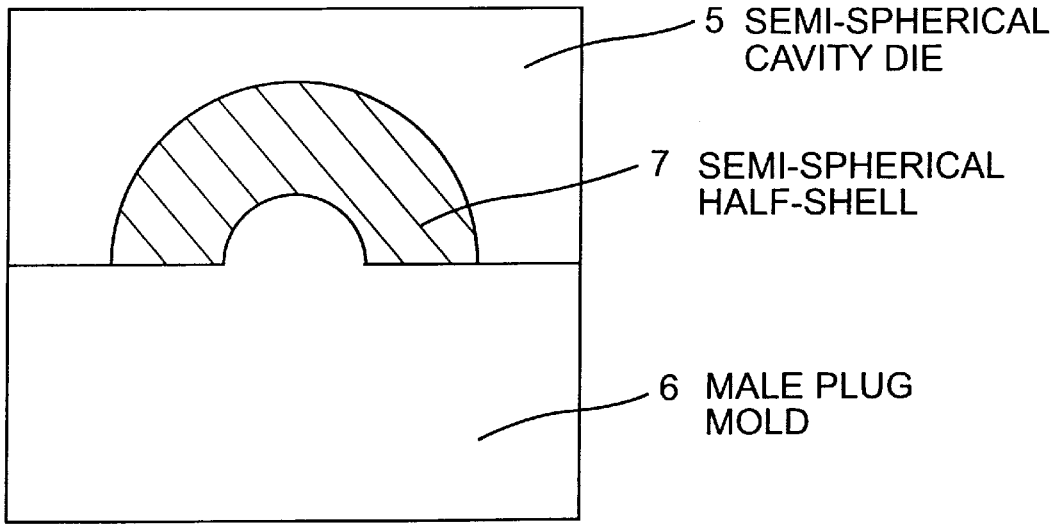
FIG. 2 is a schematic cross section illustrating one embodiment of the mold for molding the hollow core outer layer of the golf ball of the present invention.

A semi-spherical half-shell 7 was formed by mixing the following core rubber compositions shown in Tables 1 and 2 with a kneader, and press-molding the mixture at 170° C. for 10 minutes using a semi-spherical cavity die 5 and a male plug mold 6 having a semi-spherical convex plug shown in FIG. 2. The two semi-spherical half-shells were adhered with instantaneous adhesive which is commercially available to obtain a spherical inner hollow core outer layer having a thickness of 5 mm. A semi-vulcanized semi-7spherical half-shell was formed by using the same core rubber composition as the inner hollow core outer layer. The spherical inner hollow core outer layer described above was covered with the two semi-vulcanized half-shells, and then vulcanized and press-molded at the following vulcanizing temperature shown in Tables 1 and 2 for 20 minutes using a mold for molding a core shown in FIG. 3 to obtain a hollow core having a diameter of 38.4 mm. The diameter of the hollow portion, JIS-C hardness and deformation amount of the resulting hollow core were measured, and the results are shown in Tables 4 and 5.

TABLE 1

(parts by weight)

| | Example No. | | | | | | |
|---|---|---|---|---|---|---|---|
| | 1 | 2 | 3 | 4 | 5 | 6 | 7 |
| BR-18 *1 | 100 | 100 | 100 | 100 | 100 | 100 | 100 |
| Zinc acrylate | 31 | 31 | 29 | 33 | 27 | 31 | 31 |
| Zinc oxide | 20 | 20 | 20 | 20 | 20 | 20 | 20 |
| Antioxidant *2 | 0.5 | 0.5 | 0.5 | 0.5 | 0.5 | 0.5 | 0.5 |

TABLE 1-continued

| | Example No. | | | | | | |
|---|---|---|---|---|---|---|---|
| | 1 | 2 | 3 | 4 | 5 | 6 | 7 |
| Dicumyl peroxide | 1.1 | 1.8 | 3.0 | 1.8 | 1.5 | 1.5 | 1.2 |
| Barium sulfate | 16 | 17 | 18 | 16 | 18 | 5 | — |
| Tungsten | — | — | — | — | — | — | 41 |
| Vulcanizing temperature (° C.) | 147 | 157 | 160 | 157 | 157 | 157 | 147 |

(parts by weight)

TABLE 2

| | Comparative Example No. | | | | | |
|---|---|---|---|---|---|---|
| | 1 | 2 | 3 | 4 | 5 | 6 |
| BR-18 *1 | 100 | 100 | 100 | 100 | 100 | 100 |
| Zinc acrylate | 31 | 27 | 35 | 22 | 31 | 31 |
| Zinc oxide | 20 | 20 | 20 | 20 | 20 | 20 |
| Antioxidant *2 | 0.5 | 0.5 | 0.5 | 0.5 | 0.5 | 0.5 |
| Dicumyl peroxide | 0.9 | 3.0 | 2.0 | 1.2 | 1.2 | 1.2 |
| Barium sulfate | 16 | 18 | 15 | 19 | 3 | 3 |
| Tungsten | — | — | — | — | — | — |
| Vulcanizing temperature (° C.) | 147 | 160 | 147 | 157 | 167 | 157 |

(parts by weight)

*1: High cis-1,4-Polybutadiene (trade name "BR-18") available from JSR Co., Ltd.
*2: Antioxidant (trade name "Yoshinox 425") available from Yoshitomi Pharmaceutical Co., Ltd.

Production of hollow golf ball

The cover composition shown in Table 3 was covered on the hollow core obtained as described above by injection-molding to obtain a hollow golf ball having a diameter of 42.8 mm. The flight distance (total distance) and shot feel of the resulting golf ball were measured or evaluated. The results are shown in Table 4 and Table 5. The test methods are described later.

TABLE 3

| Cover composition | Amount (parts by weight) |
|---|---|
| Hi-milan 1706 *3 | 100 |
| Hi-milan 1605 *4 | 100 |
| Titanium dioxide | 5 |

*3: Hi-milan 1706 (trade name), ethylene-methacrylic acid copolymer ionomer resin obtained by neutralizing with zinc ion, manufactured by Mitsui Du Pont Polychemical Co., Ltd.
*4: Hi-milan 1605 (trade name), ethylene-methacrylic acid copolymer ionomer resin obtained by neutralizing with sodium ion, manufactured by Mitsui Du Pont Polychemical Co., Ltd.

Comparative Example 6

Production of solid core

Figure 3:
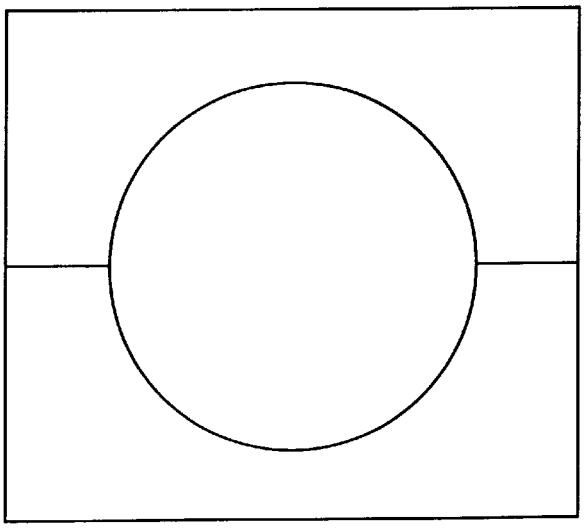
FIG. 3 is a schematic cross section illustrating one embodiment of the mold for molding the hollow core of the golf ball of the present invention.

A solid core was obtained by mixing the core rubber composition shown in Table 2 and vulcanizing or press-molding the mixture at 165° C. or 20 minutes using the mold for molding core shown in FIG. 3 to obtain a solid core having a diameter of 38.4 mm. The diameter of the hollow portion, JIS-C hardness and deformation amount of the resulting core were measured, and the results are shown in Table 5.

Production of solid golf ball

The cover layer was formed to obtain a solid golf ball as described in Examples 1 to 7 and Comparative Examples 1 to 5, except for using the solid core obtained as described above. The flight distance (total distance) and shot feel of the resulting golf ball were measured or evaluated. The results are shown in Table 5. The test methods are described as follows.

(Test method)

(1) Deformation amount

The compressive deformation amount of golf balls was determined by measuring a deformation amount when applying from an initial load of 10 kgf to a final load of 130 kgf on the core.

(2) Flight distance

After a driver was amount on a swing robot manufactured by True Temper Co. and the golf ball was hit at a head speed of 45 m/sec, total as flight distance was measured. Total distance is carry+run. Carry is a distance to the point firstly dropping on the ground of the hit golf ball. Run is a distance from the point firstly dropping on the ground to a stop point finally reached.

(3) Shot feel

The shot feel at the time of hitting of the golf ball is evaluated by 10 golfers according to a practical hitting test using a No.1 wood club (a driver). The evaluation criteria are as follows.

(Evaluation criteria)

○: Very good

Δ: Fairly good

×: Poor

TABLE 4

| Test item | Example No. | | | | | | |
|---|---|---|---|---|---|---|---|
| | 1 | 2 | 3 | 4 | 5 | 6 | 7 |
| (Core) | | | | | | | |
| Diameter of hollow portion (mm) | 15 | 15 | 15 | 15 | 15 | 8 | 22 |
| Surface hardness (JIS-C) | 77 | 84 | 91 | 84 | 84 | 80 | 83 |
| Deformation amount (mm) | 3.0 | 3.0 | 3.0 | 2.0 | 3.5 | 3.0 | 3.0 |
| (Golf ball) | | | | | | | |
| Total flight distance (yard) | 231.6 | 236.3 | 236.4 | 236.9 | 233.0 | 235.4 | 235.7 |
| Shot feel | ○ | ○ | ○ | ○ | ○ | ○ | ○ |

TABLE 5

| Test item | Comparative Example No. | | | | | |
|---|---|---|---|---|---|---|
| | 1 | 2 | 3 | 4 | 5 | 6 |
| (Core) | | | | | | |
| Diameter of hollow portion (mm) | 15 | 15 | 15 | 15 | 3 | 0 |
| Surface hardness (JIS-C) | 74 | 94 | 84 | 84 | 80 | 80 |
| Deformation amount (mm) | 3.0 | 3.0 | 1.5 | 4.0 | 3.0 | 3.0 |
| (Golf ball) | | | | | | |
| Total flight distance (yard) | 223.4 | 236.9 | 236.4 | 220.9 | 235.2 | 235.1 |
| Shot feel | ○ | Δ | Δ | ○ | X | X |

As is apparent from the comparison of the physical properties of the golf balls of Examples 1 to 7 5 shown in Table 4 with those of the golf balls of Comparative Examples 1 to 6 shown in Tables 5, the golf balls of the present invention of Examples 1 to 7, of which the hollow portion has a diameter of 5 to 25 mm, the hollow core has a surface hardness of 77 to 91 in JIS-C hardness and a deformation amount when applying from an initial load of 10 kgf to a final load of 130 kgf on the core of 2.0 to 3.5 mm, have longer flight distance and better shot feel.

When the surface hardness of the core of the hollow golf ball is lower than 77 (such as the golf ball of Comparative Examples 1), flight distance is short. Therefore, when the surface hardness is not less than 77, rebound characteristics of the resulting golf ball are high. When the surface hardness of the core is within the range of 77 to 91, shot feel of the resulting golf ball is not degraded. On the other hand, when the surface hardness is higher than 91 (such as the golf ball of Comparative Example 2), shot feel is slightly degraded. When the deformation amount of the core is smaller than 2.0 mm (such as the golf ball of Comparative Example 3), shot feel is degraded. On the other hand, when the deformation amount is larger than 2.0 mm, shot feel is good. When the deformation of the core is within the range of 2.0 to 3.5 mm, the flight distance of the resulting golf ball is not reduced if the deformation amount is large. However, when the deformation amount is larger than 3.5 mm (such as the golf ball of Comparative Example 4), flight distance is very short. When the deformation amount is larger, the deformation amount of the resulting golf ball at the time of hitting is large and degrades the durability. The golf ball of Comparative Example 5, of which a diameter of hollow portion is small, has not a sufficient deformation amount inherent to the hollow core to reduce flight distance. In the solid golf ball of Comparative Example 6, shot feel is very poor because the golf ball has not a hollow- portion, in spite of having the surface hardness and deformation amount within the range of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hollow golf ball comprising a hollow core composed of a hollow portion, which is void of any structure, and at least one hollow core outer layer, said hollow core outer layer having a composition comprising rubber, a resin or a mixture thereof, and a cover formed on the hollow core outer layer, wherein the hollow portion has a diameter of 10 to 20 mm, and the hollow core outer layer has a surface hardness of 77 to 91 in JIS-C hardness and a deformation amount of 2.0 to 3.5 mm when applying from an initial load of 10 kgf to a final load of 130 kgf on the core.

2. The hollow golf ball according to claim 1, wherein the hollow portion has a diameter of 8 to 22 mm.

3. The hollow golf ball according to claim 1, wherein the hollow portion has a diameter of 10 to 20 mm.

4. The hollow golf ball according to claim 1, wherein the hollow core outer layer has a surface hardness of 80 to 88 in JIS-C hardness.

5. The hollow golf ball according to claim 1, wherein the hollow core outer layer has a deformation amount of 2.0 to 3.0 mm when applying from an initial load of 10 kgf to a final load of 130 kgf on the core.

6. The hollow golf ball of claim 1, wherein the hollow core outer layer has a thickness of not less than 5 mm.

7. The hollow golf ball of claim 1, wherein the internal pressure of the hollow core is about atmospheric pressure to 1 $kgf/cm^2$.

* * * * *